US005542861A

United States Patent [19]

Anhalt et al.

[11] Patent Number: 5,542,861

[45] Date of Patent: Aug. 6, 1996

[54] COAXIAL CONNECTOR

[75] Inventors: John W. Anhalt, Orange; Wayne A. Zahlit, Mission Viejo, both of Calif.

[73] Assignee: ITT Corporation, New York, N.Y.

[21] Appl. No.: 778,949

[22] PCT Filed: Nov. 21, 1991

[86] PCT No.: PCT/US91/08673

§ 371 Date: Dec. 16, 1991

§ 102(e) Date: Dec. 16, 1991

[87] PCT Pub. No.: WO93/10578

PCT Pub. Date: May 27, 1993

[51] Int. Cl.[6] ..... H01R 9/07

[52] U.S. Cl. ..... 439/578; 439/585

[58] Field of Search ..... 439/578–585, 439/675, 877

[56] References Cited

U.S. PATENT DOCUMENTS

| | | | |
|---|---|---|---|
| 3,103,548 | 9/1963 | Concelman | 174/89 |
| 3,112,977 | 12/1963 | Long et al. | 339/177 |
| 4,280,749 | 7/1981 | Hemmer | 339/177 |
| 4,400,050 | 8/1983 | Hayward | 339/177 |
| 4,445,745 | 5/1984 | Cartesse | 339/177 |
| 4,869,690 | 9/1989 | Frear et al. | 439/585 |
| 4,941,850 | 7/1990 | Ankers et al. | 439/585 |
| 4,990,104 | 2/1991 | Schieferly | 439/578 |
| 5,110,308 | 5/1992 | Nishikawa et al. | 439/585 |

FOREIGN PATENT DOCUMENTS

| | | | |
|---|---|---|---|
| 1007053 | 10/1965 | United Kingdom | 439/585 |
| 1328604 | 8/1973 | United Kingdom | 439/585 |
| 1411067 | 10/1975 | United Kingdom | 439/585 |

*Primary Examiner*—David L. Pirlot
*Attorney, Agent, or Firm*—Freilich Hornbaker Rosen

[57] ABSTRACT

A low-cost miniature coaxial connector is provided, which attaches securely to a coaxial cable. The connector includes inner and outer contacts (30, 32, FIG. 2) constructed of rolled sheet metal and separated by an insulator (34). An inner ferrule (70) formed from a seamless tube, is first crimped around the jacket (24) of the coaxial cable. The braided outer conductor (22) of the cable is wrapped backwards around the crimped inner ferrule. The rear end (60) of the outer contact is held tightly around the braiding by an outer ferrule (72) that is crimped around the rear end of the outer contact. By crimping to the jacket (24) of the cable, the connector is securely held to the cable to withstand relatively large forces pulling the cable away from the connector. The sheet metal outer contact (32) can be reliably crimped in place by the seamless outer ferrule (72) which is crimped around it to hold it tightly around the braiding of the cable outer conductor (22).

5 Claims, 5 Drawing Sheets

COAXIAL CONNECTOR

BACKGROUND OF THE INVENTION

Miniature coaxial connectors are often constructed with machined inner and outer contacts. Since the contacts are of a relatively complex shape, machining them can be expensive. Sheet metal parts have not been widely used because it can be difficult to attach them to the cable so as to withstand moderate forces pulling the cable away from the connector. A connector which could be constructed at low cost, but which could be reliably held to a coaxial cable, would be of value.

SUMMARY OF THE INVENTION

In accordance with one embodiment of the present invention, a low-cost coaxial connector and cable assembly is provided, as well as the connector itself, wherein the connector is reliably secured to the cable. The connector includes inner and outer contacts and an insulator between them. The outer contact is formed of sheet metal rolled to a largely cylindrical shape. A rear portion of the outer contact is mechanically and electrically connected to the cable by first crimping a ferrule around insulation of the cable, preferably around the outer insulation or jacket of the cable. The outer conductor of the cable is placed around the crimped inner ferrule, the rear portion of the outer contact is placed around the cable outer conductor, and an outer ferrule is crimped around the sheet metal outer contact. Where the inner ferrule is crimped to the outer insulator or jacket of the cable, the connection provides a high holding force between the outer contact and the jacket of the cable to withstand substantial forces that tend to pull the cable out of the connector. Although the ferrules are seamless, they can be constructed at low cost from ordinary seamless tubing. This allows the connector contacts, especially the outer contact, to be constructed of rolled sheet metal, which enables contact construction at low cost.

The novel features of the invention are set forth with particularity in the appended claims. The invention will be best understood from the following description when read in conjunction with the accompanying drawings.

DESCRIPTION OF THE PREFERRED EMBODIMENT

Figure 1:
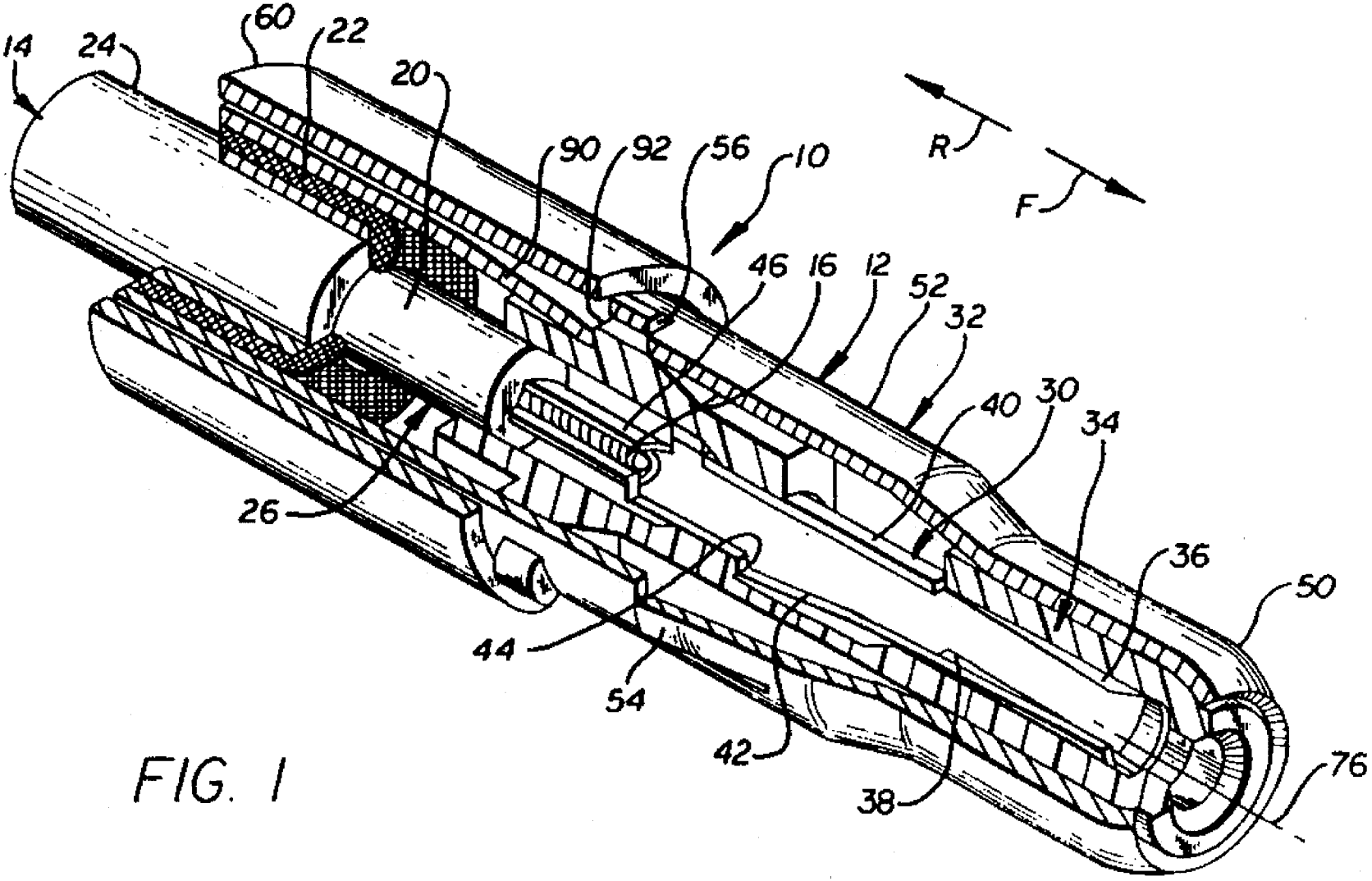
FIG. 1 is a sectional isometric view of a coaxial connector and cable assembly constructed in accordance with the present invention.
Figure 2:
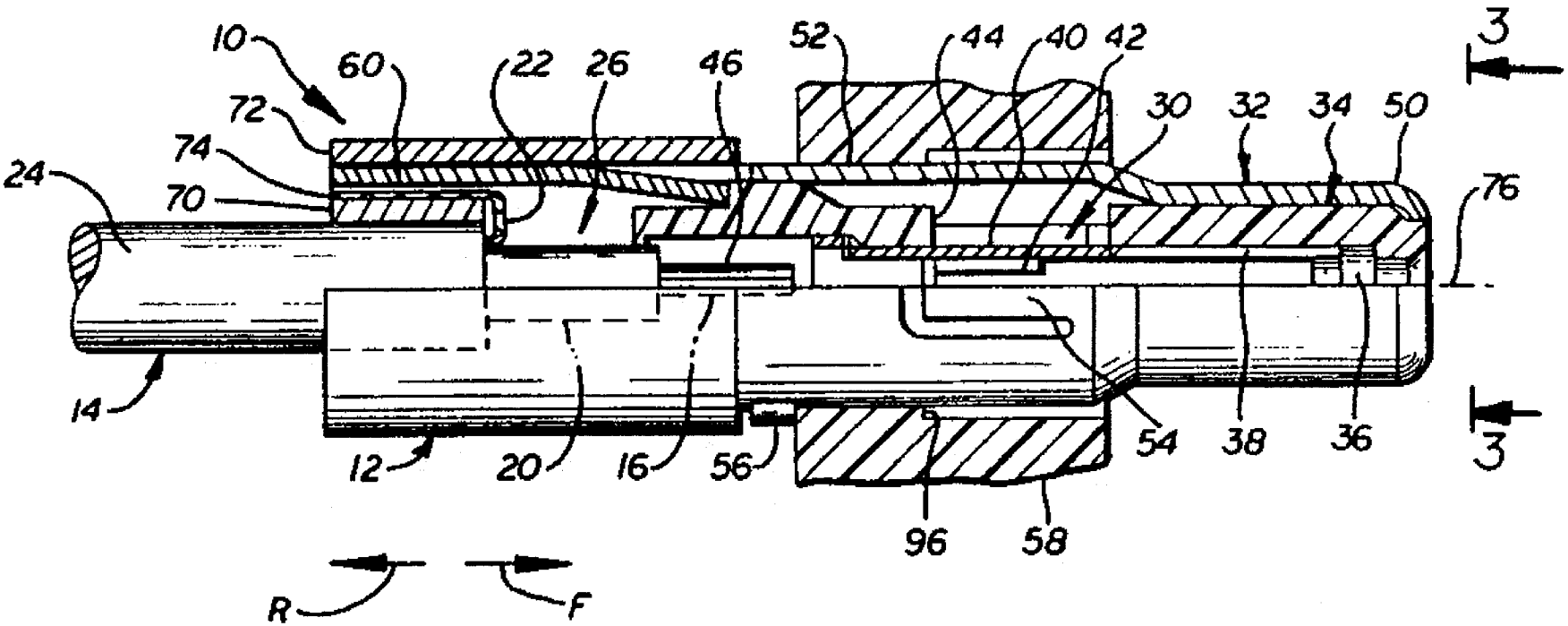
FIG. 2 is a side view of the assembly of FIG. 1, with the portion above the central line or axis being shown in section and the portion therebelow being shown in elevation.

FIGS. 1 and 2 illustrate an assembly 10 of a coaxial connector 12 and a coaxial cable 14. The cable includes an inner conductor 16, an inner insulation 20 that generally surrounds the inner conductor, an outer conductor 22 that generally surrounds the inner insulation 20, and an outer insulation or jacket 24 that generally surrounds the outer conductor 22. A forward end portion 26 of the cable (with respect to forward direction F) has been stripped to remove a forward portion of the inner insulator 20 and outer conductor 22 a distance rearward of the extreme front end of the cable, and to remove a portion of the jacket 24 at a more rearward location (with respect to rearward direction R).

The connector 12 includes inner and outer contacts 30, 32 and a molded dielectric insulator 34 between them. The inner contact 30 has a forward portion 36 with slots 38 to form a socket to receive a pin contact. The inner conductor has a middle part 40 with tines 42 extending with an outward-rearward directional component to engage a shoulder 44 on the insulator, to retain the inner contact against rearward movement. A rearward portion 46 of the inner contact is designed to be crimped around the inner conductor 16 of the cable to connect thereto. The outer contact 32 has a forward portion 50 which prevents forward movement of the insulator, a middle portion 52 with tines 54 and bosses 56 for retaining the outer contact in a retaining wall which may be part of a connector housing, circuit board, etc. The outer contact has a rearward portion 60 which is intended to be electrically connected to the outer conductor 22 of the cable, and which also mechanically holds to the cable to prevent the cable from being pulled rearwardly out of the connector.

Applicant uses inner and outer ferrules 70, 72 to securely hold the rear portion 60 of the outer contact in good electrical connection with the cable outer conductor 22 and in good mechanical connection with the jacket 24 of the cable. The inner ferrule 70 is crimped around the cable jacket 24. The outer conductor 22 of the cable is in the form of a braiding, and is wrapped backwardly so it includes a portion 74 that lies around the crimped inner ferrule 70. The outer ferrule 72 is crimped around the rear portion 60 of the outer contact to deform it radially inwardly with respect to the axis 76 of the combination so as to both electrically and mechanically connect the outer contact to the cable outer conductor portion 74 and through it and the inner ferrule to the cable jacket 24.

Figure 4:
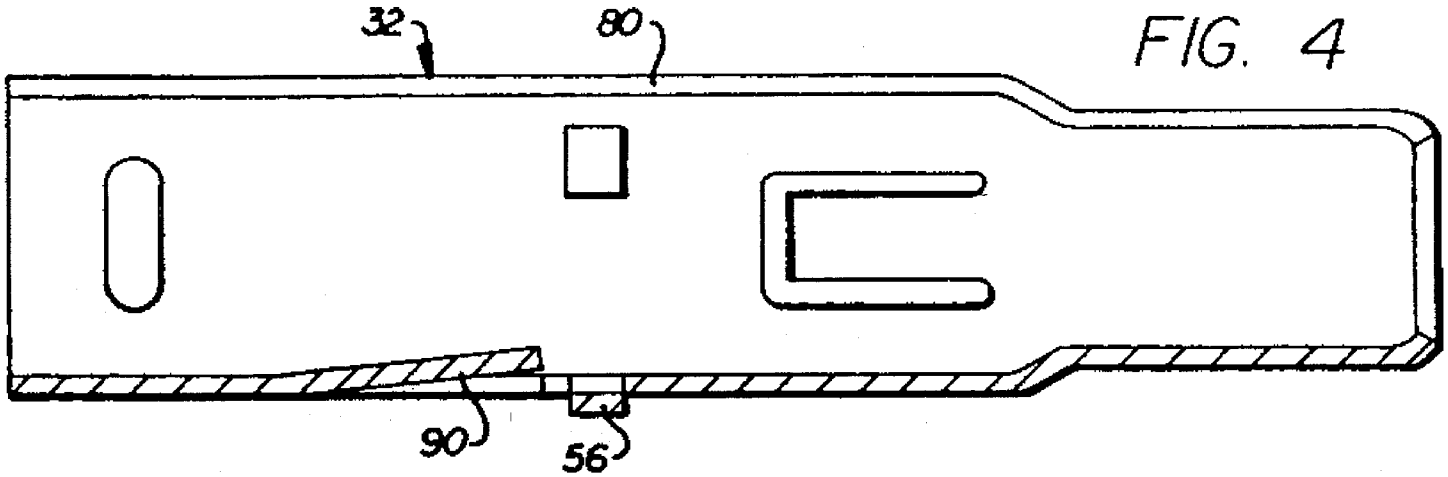
FIG. 4 is a sectional side view of the outer contact of the connector of FIG. 2.
Figure 3:
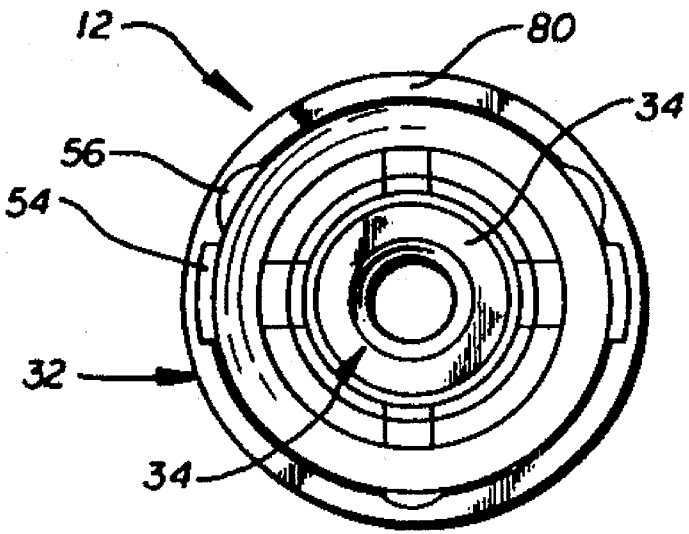
FIG. 3 is a view taken on the line 3—3 of FIG. 2.
Figure 5:
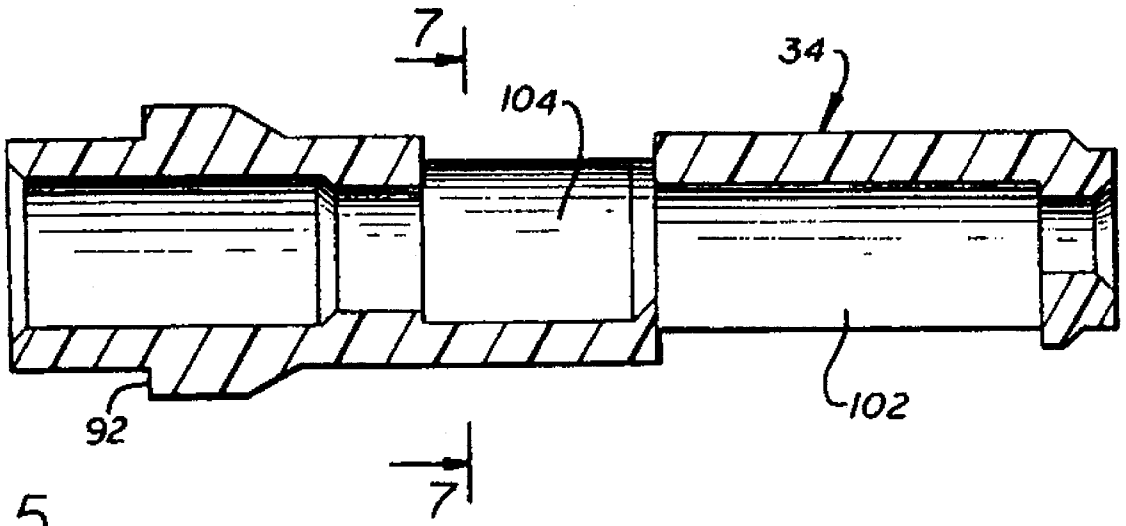
FIG. 5 is a sectional side view of the insulator of the connector of FIG. 2.
Figure 6:
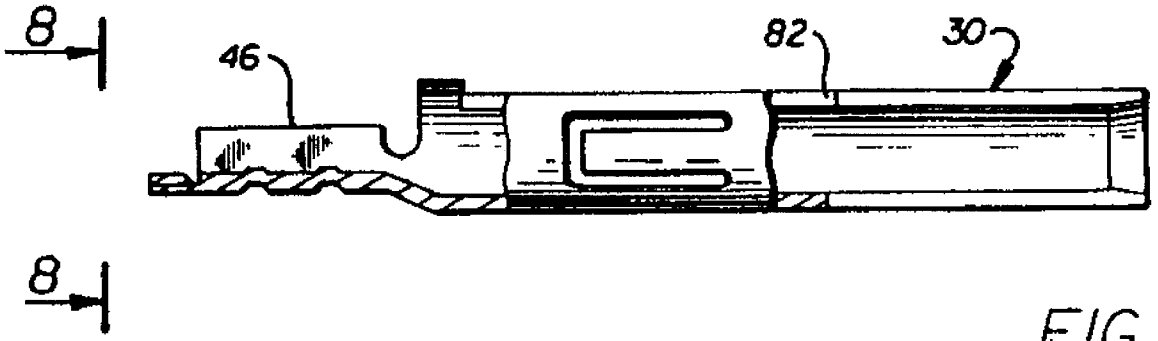
FIG. 6 is a partial sectional side view of the inner contact of the connector of FIG. 2.
Figure 8:
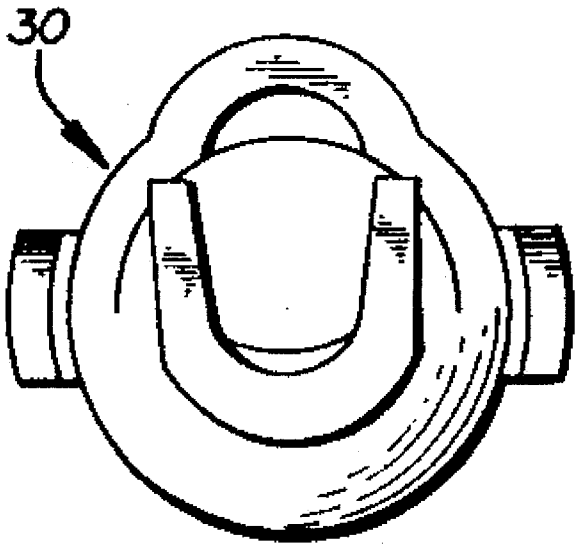
FIG. 8 is a view taken on the line 8—8 of FIG. 6.
Figure 7:
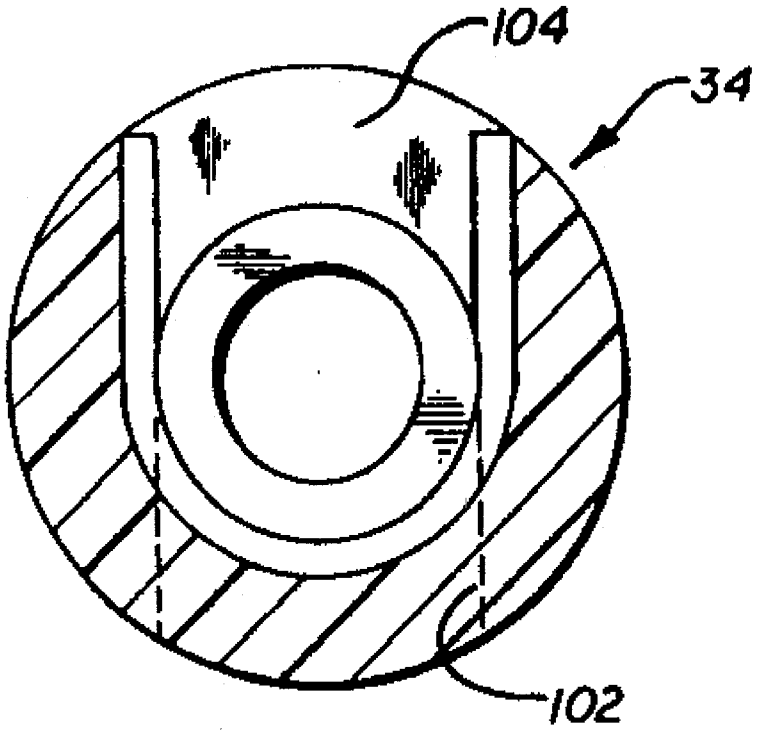
FIG. 7 is a sectional view taken on the line 7—7 of FIG. 5.

In order to construct the coaxial connector 12 at low cost, applicant forms the inner and outer contacts 30, 32 of sheet metal, with each contact formed by stamping the part out of sheet metal and deforming the sheet metal into largely cylindrical portions using progressive dies. The resulting parts each has a seam at 80, 82 (FIGS. 4 and 6) where the edges of the sheet metal part come together but are unjoined, so the seams are left in their original state in that the edges of the sheet at the seam are not welded or otherwise joined together. Although the sheet metal parts can be constructed at low cost, they cannot perform all the functions of similar parts constructed of solid metal that has been machined to the desired shape. Specifically, the rear portion of the outer contact cannot itself, be reliably crimped around the cable. However, applicant can resort to the low cost crimping process for joining, by the use of the ferrules 70, 72.

The ferrules 70, 72 are formed of sections of continuous, or seamless tubes. Because of the simplicity of the tubes, they are available at low cost, and yet their construction enables them to be reliably crimped to devices. By crimping the inner ferrule 70 directly around the cable jacket 24, applicant provides a reliable mechanical connection to the cable jacket, which is the strongest part of the cable in tension load, and therefore the best part to attach to to prevent pullout of the cable from the connector. By the use of the outer ferrule 72 which can be reliably crimped, applicant is able to securely hold the outer contact rearward portion in mechanical and electrical engagement with the cable outer conductor 22, and through it to the inner ferrule 70 which is securely held to the cable jacket. The result is a good electrical connection and a good mechanical connection to the strongest part of the cable to provide for high reliability. This is accomplished using a rolled sheet metal outer contact which can be constructed at low cost, and a pair of ferrules whose outsides are continuous and which can be manufactured at low cost from low cost tubing.

Applicant first inserts the insulator 34 within the outer contact 32, until inwardly-bent tines 90 on the outer contact snap behind a shoulder 92 on the insulator. To connect the cable to the connector, applicant first trims the cable as shown and pushes the inner and outer ferrules over the cable for later crimping thereon. The exposed end of the inner conductor 16 is placed in a pocket at the rear portion 46 of the inner contact, and the inner contact is crimped around it.

The inner ferrule 70 is placed as shown in FIG. 2 immediately behind the forward end of the jacket, and is crimped in place. The braided outer conductor 22 is then wrapped rearwardly around the inner ferrule. The cable with the inner contact attached thereto, is then inserted into the rest of the connector. Finally, the outer ferrule 72 is moved forwardly until it lies around the rearward portion of the outer contact, and the outer ferrule is then crimped in place. The combination of connector and cable installed thereon can be inserted into the retaining wall 58 (FIG. 2) until the bosses 56 on the outer contact engage a rearward face of the retaining wall. Just prior to that time, tines 54 on the outer contact will have snapped behind a retention shoulder 96 on the retaining wall.

Applicant has manufactured contacts of the construction shown, where the outer contact 32 had a length of 0.830 inch (21.8 millimeters) and a rear portion of an outer diameter of 0.186 inch (4.71 mm), with the outer contact constructed of phosphor bronze 521 having a thickness of 0.120 inch (0.31 mm) and plated with nickel, gold, and tin-lead. The inner contact 30 was constructed of the same material but with a sheet thickness of 0.008 inch (0.21 mm), and had an outer diameter along its forward portion of 0.062 inch (1.58 mm). The insulator was molded of a thermoplastic, with cavities 102, 104 provided for ease of molding. The other dimensions are shown to scale.

Thus, the invention provides a coaxial connector which can be constructed at low cost and which can be reliably electrically and mechanically connected to a coaxial cable. At least the outer contact of the connector is formed from sheet metal. The rearward portion of the outer contact can be held to the cable outer connector in a crimping joint, by the use of an outer ferrule which lies around the outer contact rearward portion and which is crimped to press the outer contact tightly against the cable outer connector. A good mechanical connection to the outer jacket of the cable is obtained by first crimping an inner ferrule to the jacket. With the braiding or outer connector of the cable folded back around the crimped inner ferrule, the later step of crimping the outer ferrule to hold the outer contact to the braiding, results in the outer contact also being mechanically held to the cable jacket through the crimped inner ferrule. Seamless ferrule are available at low cost, and enable a low cost sheet metal outer contact to be used.

Although particular embodiments of the invention have been described and illustrated herein, it is recognized that modifications and variations may readily occur to those skilled in the art, and consequently, it is intended that the claims be interpreted to cover such modifications and equivalents.

We claim:

1. A coaxial connector which terminates to a coaxial cable of the type that includes an inner conductor, an inner insulation around said inner conductor, an outer conductor in the form of a braiding that surrounds said inner insulation, and an insulative jacket around said braiding, comprising:

an inner contact connected to said inner conductor;

an outer contact surrounding said inner contact;

an insulator lying between said inner and outer contacts;

an inner ferrule crimped to said jacket, with said jacket trimmed to expose said braiding and with said braiding wrapped backward around said inner ferrule;

said outer contact having a rearward portion lying about a portion of said braiding which is wrapped backward around said inner ferrule;

an outer ferrule which is crimped around said outer contact rearward portion to hold said outer contact rearward portion crimped around said braiding, with said outer ferrule lying about said inner ferrule but with said inner ferrule crimped independently of crimping of said outer ferrule.

2. A coaxial connection assembly comprising:

a coaxial cable that includes an inner conductor, an inner insulation generally surrounding said inner conductor, an outer cable conductor generally surrounding said inner insulation, and an insulative jacket generally surrounding said outer conductor;

a coaxial connector having an axis, an inner contact formed of sheet metal with a middle portion bent substantially into a cylinder with adjacent edges and with a rearward end bent into at least part of a cylinder, said connector also having an outer contact formed of sheet metal with portions each bent into a cylinder, said connector also including a dielectric plastic molded insulator lying between said inner and outer contacts with said insulator having a forwardly-facing shoulder and a rearwardly-facing shoulder;

said inner contact having a tine abutting a first of said shoulders and said outer contact having a tine abutting the other of said shoulders, to trap said insulator against axial movement relative to said contacts;

said inner conductor lying in said rearward end of said inner contact and with said inner contact crimped thereto;

said outer contact surrounding said outer cable conductor and crimped thereabout in a mechanical and electrical connection therewith.

3. The connection assembly described in claim 2 including:

an inner ferrule surrounding and crimped to said jacket, with said outer cable conductor folded back around said ferrule;

said outer contact having a rear part that surrounds said folded back cable conductor and said inner ferrule, and including an outer ferrule surrounding said rear part of said outer contact and crimped thereabout to hold said outer contact rear end tightly around and against said outer cable conductor, with said outer ferrule surrounding said inner ferrule.

4. A method for terminating a coaxial cable that has inner and outer conductors lying respectively within inner and outer insulators, to a coaxial connector which includes inner and outer conductors and a cable insulator between them, comprising:

connecting said inner cable conductor to said inner contact;

crimping an inner ferrule directly around one of said cable insulators, and wrapping a portion of said outer cable conductor around said inner ferrule;

inserting said inner ferrule and the portion of said outer conductor therearound into a rearward portion of said outer contact;

crimping an outer ferrule around a part of said outer contact rearward portion which lies around said inner ferrule, to keep said outer contact part tightly squeezed around said outer conductor.

5. The method described in claim 4 wherein:

said step of crimping an inner ferrule includes crimping it around said outer cable insulation.

* * * * *